United States Patent [19]

Friesen

[11] Patent Number: 4,679,516

[45] Date of Patent: Jul. 14, 1987

[54] SAILBOARD ASSEMBLY HAVING A LIMITED DIPLACEMENT MAST

[76] Inventor: Terry V. Friesen, 636 Santana Rd., Novato, Calif. 94947-1531

[21] Appl. No.: 837,606

[22] Filed: Mar. 7, 1986

Related U.S. Application Data

[63] Continuation-in-part of Ser. No. 656,707, Oct. 1, 1984, abandoned.

[51] Int. Cl.[4] ..... B63H 9/04

[52] U.S. Cl. ..... 114/39; 114/91; 114/93; 114/162

[58] Field of Search ..... 114/39.2, 90, 91, 93, 114/141, 162–165

[56] References Cited

U.S. PATENT DOCUMENTS

| | | | |
|---|---|---|---|
| 3,487,800 | 1/1970 | Schweitzer et al. | 114/39 |
| 4,218,986 | 8/1980 | Hackney | 114/165 |
| 4,319,538 | 3/1982 | MacFarlane | 114/165 |
| 4,439,424 | 3/1984 | Lord | 114/39.2 |

FOREIGN PATENT DOCUMENTS

| | | | |
|---|---|---|---|
| 2731266 | 2/1979 | Fed. Rep. of Germany | 114/39.2 |
| 3123967 | 1/1983 | Fed. Rep. of Germany | 114/39.2 |
| 7807777 | 1/1980 | Netherlands | 114/93 |
| 0000003 | of 1897 | United Kingdom | 114/141 |

*Primary Examiner*—Joseph F. Peters, Jr.
*Assistant Examiner*—Stephen P. Avila
*Attorney, Agent, or Firm*—Manfred M. Warren; Robert B. Chickering; Glen R. Grunewald

[57] ABSTRACT

A sailboard assembly is disclosed which has a body on which the user stands, a mast, boom and sail assembly for propulsion of the board. The mast-boom-sail assembly is mounted to the board by a mast mounting assembly which permits limited angular displacement of the mast about a generally normal orientation to the board for maneuvering of the center of pressure of the sail and yet provides support of the mast above the board upon release of the boom. The sailboard assembly also preferably includes a steering assembly having a rudder and foot-operated turntables that are used to turn the rudder.

7 Claims, 8 Drawing Figures

SAILBOARD ASSEMBLY HAVING A LIMITED DIPLACEMENT MAST

RELATED APPLICATION

This application is a continuation-in-part application based upon copending application Ser. No. 656,707, filed Oct. 1, 1984 and entitled "A SAILBOARD ASSEMBLY AND METHOD FOR CONTROLLING THE MOTION OF A SAILBOARD" and now abandoned.

TECHNICAL FIELD

This invention relates generally to wind propelled sailboard assemblies, and more particularly to steering and mast assemblies for sailboards.

BACKGROUND OF THE INVENTION

In recent years the popularity of sailboarding or wind surfing has increased dramatically. The sport began approximately 17 years ago by mounting a mast and sail assembly on a surfboard and has progressed to nationally televised highly skilled contests. In addition to the water-based sport sailboard sail assemblies even have been added to skateboards.

Initially, sailboards were constructed with masts which were pivotally mounted to the body of the board by a universal joint, which would not support or sustain the mast by itself above the board. These sailboards are in widespread use today, but control of the motion of a sailboard having a mast with a universal joint is very difficult to learn and master. Steering of such sailboards is based upon manipulation of a combination of the mast, the boom and the sailor's body position on the board.

The basic patent in the sailboarding field is U.S. Pat. No. 3,487,800 to Schweitzer et al. This patent sets forth the mast-boom-sail assembly which enables steering of the sailboard without using a steerable rudder. The mast of the sailboard is coupled to the board body by a universal joint so that the mast can be inclined or tilted from the vertical by a standing rider while the mast-boom-sail assembly is pivoted around the universal point. The combined mast tilting, boom swinging and movement of the rider's body weight on the board can be used to turn the board. When employed by a highly skilled user, the unsupported, universal joint mounted mast is very effective as a means for controlling board motion, and it provides one solution to the problem of how to steer the board while standing.

More recently sailboards have been devised in which a steerable rudder has been provided for use in combination with a tiltable, universal joint mounted mast. Typical of such sailboards is the sailboard set forth in German Patent No. 2,731,266 to Schwaiger. The Schwaiger patent discloses a sailboard having a foot operated steering system which allows the sailor to control the board's direction of travel without the need for large fore-and-aft displacements of the mast-boom-sail assembly, as is required for universal joint mounted masts which do not have steerable rudders. Sailboards with universal joint masts without steerable rudders usually are able to negotiate only slow or wide turns, making collision avoidance difficult. It is also quite common to submerge the bow of such universal joint mounted sailboards without steerable rudders while tilting the sail forward to change direction. Thus, the Schwaiger steerable rudder enhances turning and provides a simple, efficient method of steering a sailboard with a universal-jointed mast.

Still more recently, sailboards have been created in which the mast is fixed and self-supporting on the sailboard. Thus, German Patent No. 3,123,967 to Horn discloses a sailboard in which there is a fixed, non-tiltable mast that is used in conjunction with a foot-operated steering system. This form of sailboard eliminates the considerable effort even a highly skilled user must expend to coordinate the tricky task of erecting the mast-boom-sail assembly and maintaining the assembly in a substantially vertical position while the wind force tends to knock the assembly down. Thus, a fixed mast sailboard allows novices and a broader spectrum of individuals to take up the sport without the frustration of having the mast assembly continually fall into the water and without the back-straining effort of again erecting the assembly. Instead of the sailor trying to balance himself and the mast-boom-sail assembly, which may be buffeted by unsteady wind forces, he can now use the fixed mast to actually steady himself and the relatively narrow and unstable sailboard.

The fixed mast sailboard, however, also is not without its disadvantages. When beating to windward (close-hauled) the sailboard boom occupies a substantial portion of the sailboard centerline. Thus, in a light wind when the sailor is not leaning out, the boom tends to push the sailor backwards off the board when he tries to sail close-hauled. This is particularly true for wide boom assemblies such as are used in modern, highly cambered sails with the sailor standing forward near the mast. Since the mast cannot be tilted away from the sailor in a fixed boom sailboard, specialized booms, such as are disclosed in the German patent to Horn, must be employed.

Additionally, when sailing a fixed mast sailboard in heavy winds, the sailor must lean away from the boom to a substantial degree in order to produce sufficient righting moment to counter the heeling moment produced by the large wind force on the sail. Since the sailor cannot tilt the mast, some provision must be made for extending the sailor's reach to the boom, such as by boom extension assemblies or handles for high-wind sailing.

Additionally, steerable rudders on sailboards have typically included complex assemblies which have inhibited steering of the rudder in order to enable frictional securement of the rudder in any angular orientation. Moreover, sailboards having steerable rudders usually position the rudder steering mechanism in a single location, whereas the sailor is often required to move fore and aft on the board to maximize maneuvering.

While kick-up types of rudders are known in the sailing art, for example, U.S. Pat. Nos. 4,218,986 and 4,319,538, such mechanisms are not readily adaptable for use on sailboards having foot operated steering mechanisms.

OBJECTS AND SUMMARY OF THE INVENTION

A. Object of the Invention.

Accordingly, it is an object of the present invention to provide a sailboard assembly having the benefits of mast tilting or displacement as well as the benefits which result from having a self-supporting mast.

It is a further object of the present invention to provide a sailboard assembly which may be more easily maneuvered by novice sailors and requires less expenditure of energy during its use.

Another object of the present invention is to provide a sailboard assembly in which the sailor can use a combination of rudder and mast displacements to enhance maneuvering of the sailboard and yet need not provide the sole support for the mast-boom-sail assembly above the board.

Still a further object of the present invention is to provide an improved foot operated steering mechanism for a sailboard assembly which can be operated from multiple locations on the board and yet has a simplicity of construction.

A further object of the present invention is to provide a sailboard assembly having a steerable rudder which includes a kick-up feature.

Still another object of the present invention is to provide a sailboard assembly in which the mast-boom-sail can be mounted in several fore/aft locations to allow optimum balance and sailing speed.

Another object of the present invention is to provide a sailboard assembly which is easy to use, inexpensive to construct and durable.

The sailboard assembly of the present invention has other objects and features of advantage which will become apparent from and are set forth in more detail in the accompanying drawing and the following description of the preferred embodiments.

B. Summary of the Invention.

The sailboard assembly of the present invention includes a board-like body on which a sailor may stand, a mast movably mounted to the body for angular displacement about an end thereof, manually engageable boom means carried by the mast and extending away therefrom, and sail means mounted to the mast and coupled to the boom means. The improvement in the sailboard assembly of the present invention comprises, briefly, mounting means mounting the mast to the body for limited angular displacement about a normal orientation to the body, the mounting means supporting the mast in an upright generally normal orientation with respect to the body when the boom means is released by the sailor, and the mounting means permitting sufficient angular displacement of the mast relative to the body by manipulation of the boom means by the sailor to enable at least limited maneuvering of the sailboard by tilting of the mast. Most preferably the mounting means is formed as a cassette-like assembly including a resilient member positioned to bias the mast to a substantially normal orientation with respect to the body. The cassette allows universal angular displacement of the mast in the range of about 10 to about 30 degrees.

In addition the sailboard assembly preferably includes a steerable rudder assembly having a plurality of turntables mounted on the board for displacement by the sailor at different locations. The steerable rudder includes a kick-up feature and is mounted for rotation about an axis passing substantially through the center of pressure of the rudder so that frictional brakes can be eliminated from the steering assembly.

DESCRIPTION OF THE PREFERRED EMBODIMENT

Described below is a specific preferred embodiment of what the inventor considers at present to be the best mode of the assembly and operation of the invention. This is necessarily a narrow particular example of many possible ways to practice the claimed invention.

Overview

Figure 1:
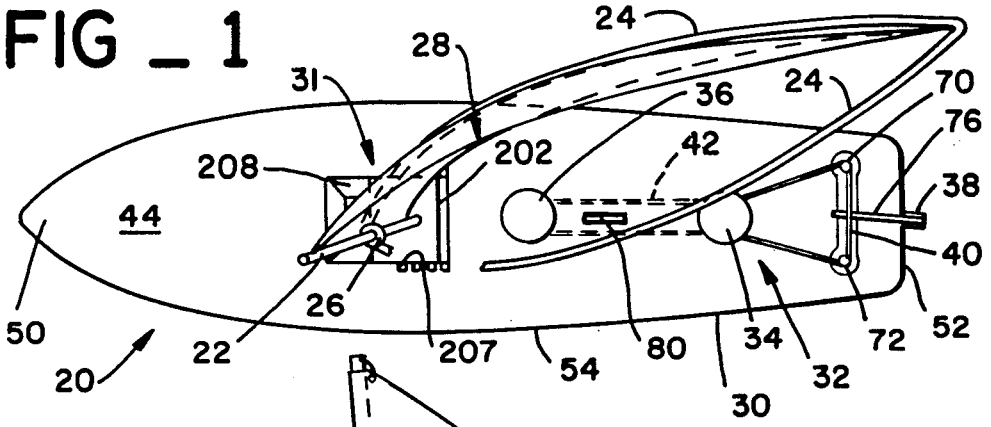
FIG. 1 is a top plan view of a sailboard assembly constructed in accordance with the present invention with a portion of the boom broken away for clarity.
Figure 2:
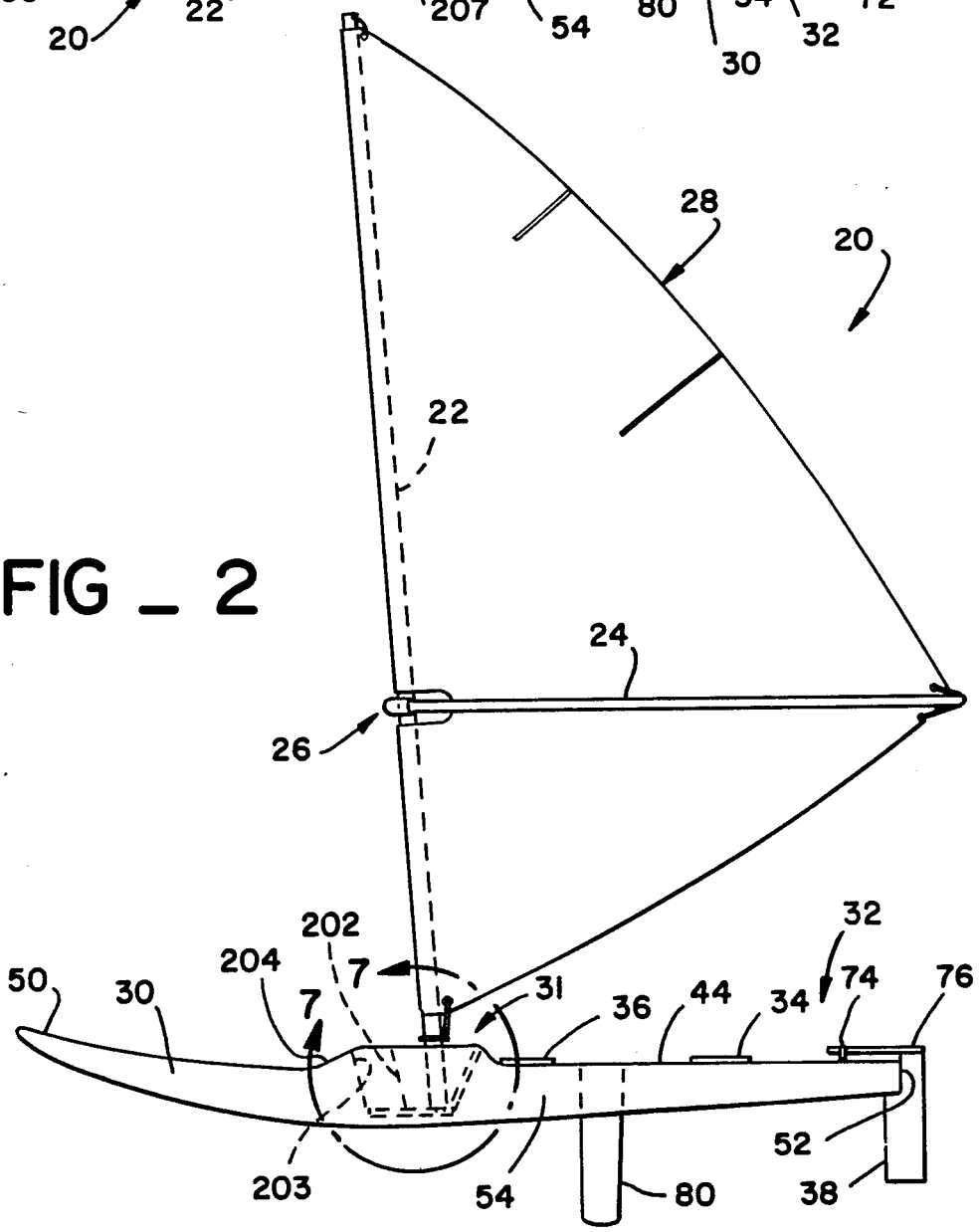
FIG. 2 is a side elevation view corresponding to FIG. 1.

Broadly stated, FIGS. 1 and 2 show the major subassemblies which cooperate to create sailboard assembly 20. The embodiments illustrated in the drawing are configured for use in water, but it will be understood that the present invention also can be employed for ice sailing or land sailing.

The sailboard assembly of the present invention includes elements which are found in prior art sailboards. Thus, the sailboard includes the basic assembly of a mast 22 mounted to a board-like body 30 and carrying a manually engageable boom 24 at a height on the mast suitable for grasping by the rider while standing on body 30. Boom 24 can be mounted to mast 22 in any one of a number of conventional manners, but most preferably a joint 26 is provided which couples the boom and mast together. Joint 26 can be formed for rotation of the boom about mast 22 or for rotation of the boom and mast as a unit. Mounted to the boom and mast is sail means, generally designated 28, which preferably extends above and below boom 24 to catch the wind.

In order to permit steering of sailboard 20 with much less energy expenditure and with a lower skill level, the sailboard assembly of the present invention employs two structures not heretofore found in sailboards. First, mast 22 is mounted on body 30 by mounting means 31 that permits tilting of the mast but also supports the mast on board 30 in a generally upright or vertical position with respect to the board. Mounting means 31 is formed to secure mast 22 to the body of the board for limited angular displacement about a normal orientation of the mast to the sailboard body. Thus, mounting means 31 is not a fixed-mast mounting means, and it is not a universal jointed mast in which the mast can be pivoted to the top deck 44 of the board. Second, a steering assembly, generally designated 32, is mounted on board body 30.

Sailboard assembly 20, therefore, includes the ability to balance the helm, and most preferable some maneuvering capability, as a result of providing a mast which is tiltable to a limited degree. Moreover, board assembly 20 provides the maneuvering advantages of a steerable rudder. Mounting means 31 is sufficiently supportive of mast 22 so as to eliminate or greatly reduce some of the balancing problems of tiltable masts. Still further the limited tilting capability of mounting means 31 overcomes the close-hauled and heavy-wind problems encountered with fixed mast sailboards.

Usually board 30 has sufficient buoyancy to support the assembly and a user on a body of water. The sailboard assembly of the present invention also can be employed with small buoyancy, water-start boards, namely boards having insufficient buoyancy to support the user while standing. Such boards depend upon hydrodynamic lift (planing) to support the user.

Steering assembly 32 is formed to be operable by the user or sailboard rider while standing and while grasping boom 24, preferably by providing a foot actuated steering assembly. In the embodiment illustrated, subassembly 32 includes at least a first or aft turntable 34, and preferably a second or fore turntable 36, which are coupled to each other and to a movable, preferably pivotally mounted, rudder 38 by a system of a first cable 40 and a second cable 42.

In operation, a sailor (not shown) stands on a top surface 44 of body 30 within leg reach of one of the turntables 34, 36 so the user's foot can frictionally engage a turntable to rotate it for adjusting the angle of attack of rudder 38. Using his hands, the user grasps boom 24 and rotates the boom about or with the mast in mount 31 to align sail means 28 to capture the wind. The mast-boom-sail assembly also can be tilted to a limited degree in mounting means 31 to aid in maneuvering. While grasping boom 24, the user steers assembly 20 by a combination of manual mast manipulation and foot manipulation of turntable 34 or turntable 36.

Since mounting means 31 will not allow mast 22 to fall to deck 44, the mast is self-supporting, and it is a simple matter to climb onto the board and begin sailing. The rider need not first raise mast 22, and when boom 24 is released, it merely rotates around until sail 28 is parallel to the wind and the mast pivots to an upright position. The board remains relatively motionless while the rider clambers aboard and then stands up using the self-supporting, but tiltable mast to steady himself. Once standing and stabilized, rudder 38 can be adjusted using turntables 34 and/or 36, and the user can then grab the boom to bring sail 28 around to catch the wind.

The novice can perform these moves almost immediately, and with minimal instruction. Since the sailboard assembly is not moving to any significant degree at the start, the novice also can manipulate the boom and rudder to gradually produce motion at the outset to enable the user to begin to get a feeling for the dynamics of sailboard riding. If the rider is familiar with conventional sailboating, learning to sail on the sailboard assembly of the present invention is accelerated.

It is, of course, still possible to tip the sailboard assembly over, just as can occur with a conventional sailboat. Righting the sailboard assembly of the present invention, however, is easier than righting even a conventional small sailboat because the sail area and mast height are generally smaller. To raise sail means 28 and mast 22 out of the water and back to the upright position, the user positions body 30 so fore end 50 faces into the wind and aft end 52 faces away from the wind. By pulling on the top side of the board, for example port side 54 approximately opposite the mast, and pushing on the starboard side of the board with his feet, the sailor can rotate the assembly and pull mast 22 up out of the water and back to the upright position. The wind, coming out of the direction of fore end 50, will align sail means 28 and boom 24 to be substantially parallel to the longitudinal axis of body 30. Mounting means 31 will maintain the mast-boom-sail assembly elevated over the body of the board, and the board will not move forward significantly.

With the sailboard assembly 20 stabilized and immobile, the user can slide back onto body 30, stand up, and once again grasp boom 24 and position his feet adjacent turntable 34 or 36. The user is now in a position to adjust the rudder and pull or push the mast and boom so sail means 28 once again captures the wind to propel sailboard assembly 20.

Mast Mounting Subassembly.

Figure 7:
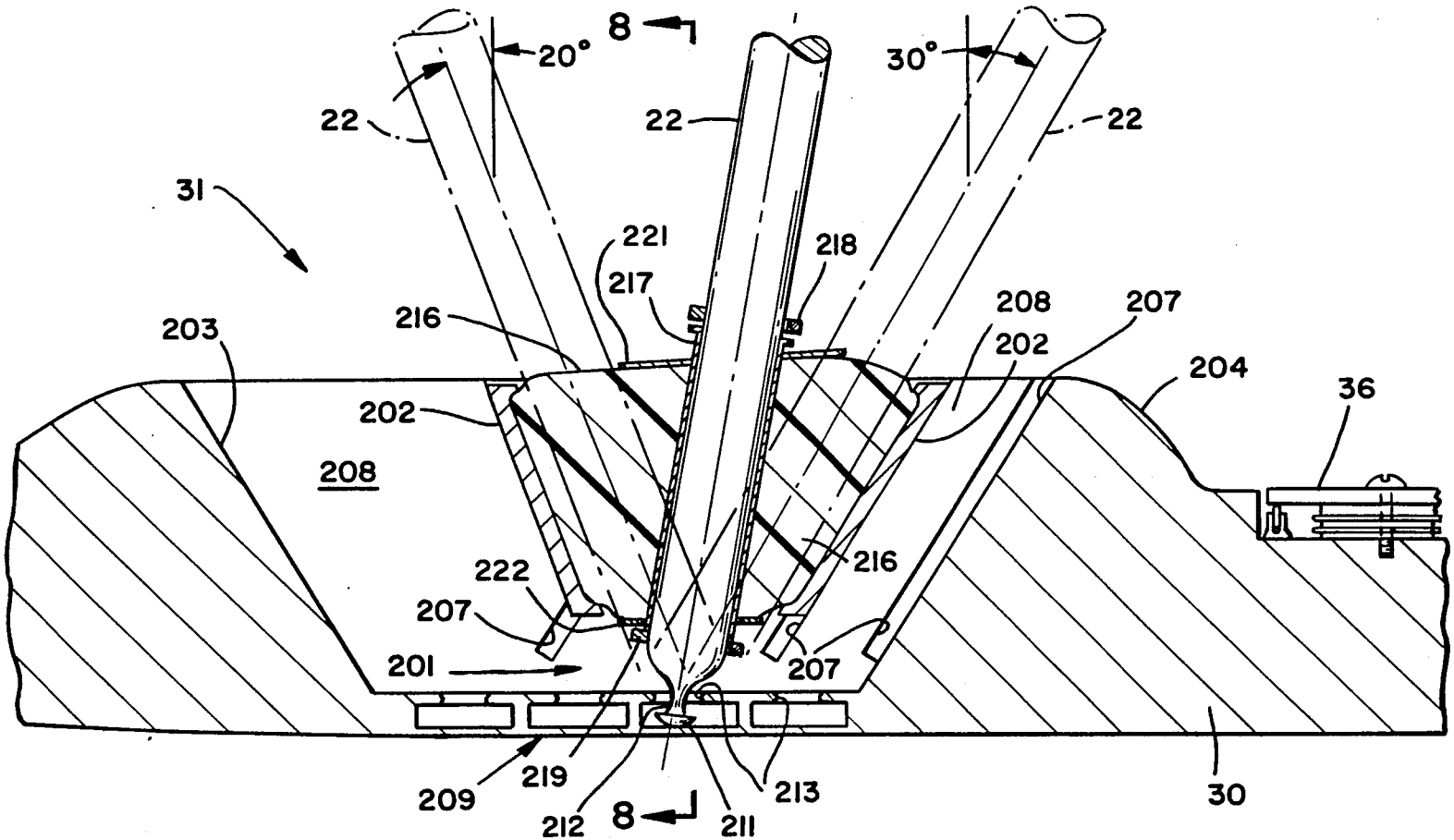
FIG. 7 is an enlarged, fragmentary, side elevation view in cross section of substantially the area bounded by line 7—7 in FIG. 2.
Figure 8:
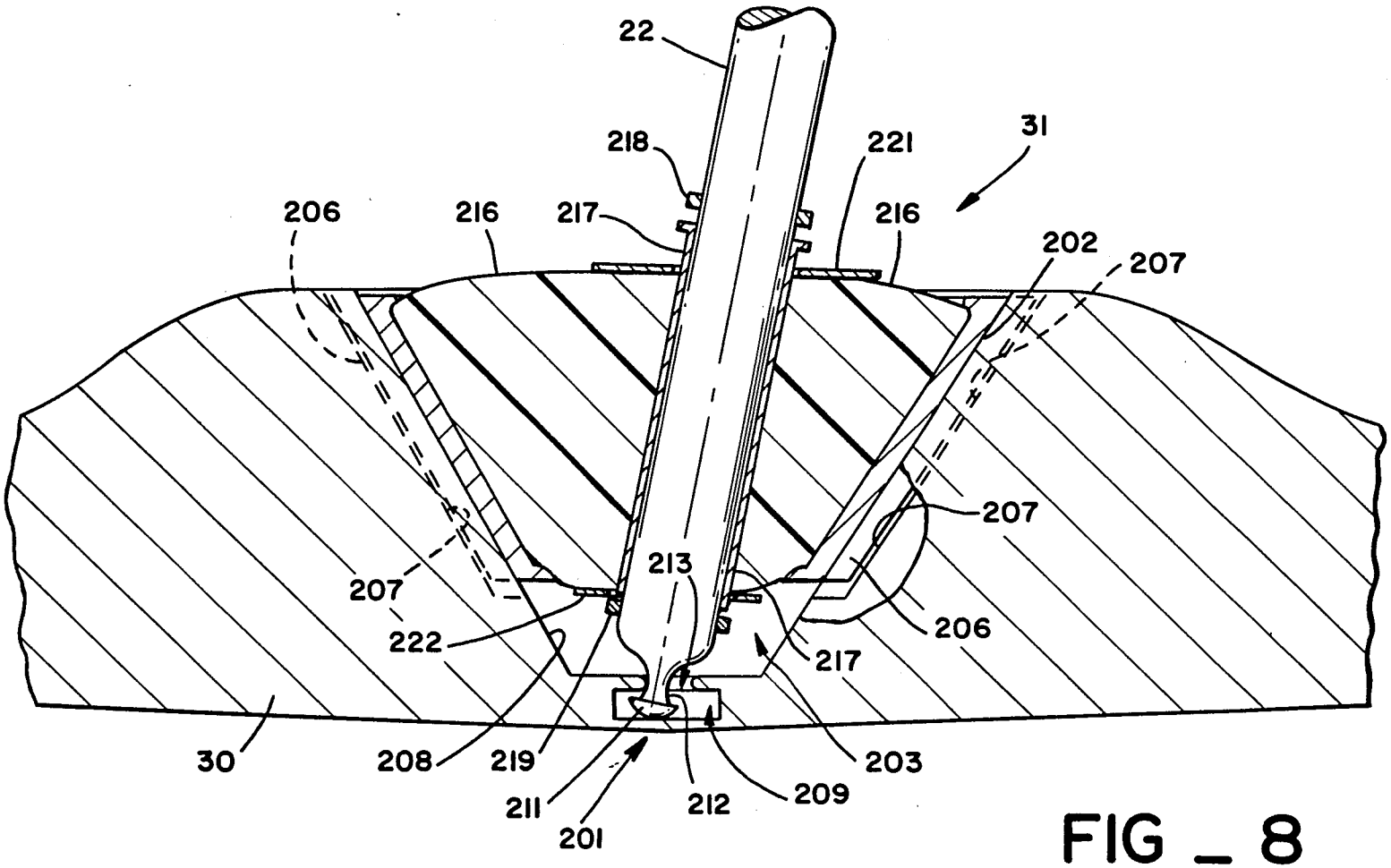
FIG. 8 is an enlarged, fragmentary, end elevation view in cross-section taken substantially along the plane of line 8—8 in FIG. 7.

The details of construction of mast mounting subassembly 31 may best be seen by reference to FIGS. 1, 7 and 8. In order to permit limited angular displacement of mast 22 while still supporting the mast-boom-sail assembly in a generally vertical upright position on the body 30 of the sailboard, it is preferable to form mounting means 31 for universal articulation of mast 22 about an end 201 of the mast which is coupled to body 30 by mounting means 31. In the preferred form, the mounting means is provided by a cassette-like assembly including a rigid, truncated pyramidal collar member 202 which is mounted in a cavity 203 provided in a thickened section 204 of the board. Mounting of cassette to cavity 203 is accomplished by laterally extending flanges or fins 206 on either side of pyramid collar 202 which project into slots 207 formed in the opposite sidewalls 208 of cavity 203. The clearance shown in FIG. 8 is exaggerated for the purpose of clarity.

As best may be seen in FIG. 7, there is preferably a plurality of pairs of slots 207 in opposed sidewalls 208 so that the mast-mounting cassette 202 can be positioned in a selected pair of slots to enable variation of the location of the mast fore and aft. Additionally, slots 207 are advantageously tilted or skewed from the vertical in the direction of the aft end 52 of the board.

In the preferred form of mounting means 31, pyramid mounting member 202 will permit articulation of mast 22 about end 201 to not more than about 30 degrees from a normal orientation with respect to body 30 in any direction. Thus, mast 22 can be tilted up to about 30 degrees by the sailor in order to move the center of pressure of the sail with respect to body 30 and rudder 38 so as to permit at least limited maneuvering of the sailboard by tilting of the mast.

It is contemplated in the sailboard of the present invention that the amount of articulation about the normal which will be permitted by mounting means 31 may well vary with the experience of the sailor using sailboard assembly 20. Thus, a novice or less experienced sailor may employ a cartridge 202 which permits articulation to not more than about 15 degrees from normal with respect to the body of the sailboard. This limits the maneuverability of the board by tilting of the mast, but it also supports the mast more rigidly to assist the sailor in maintaining his or her balance.

As can be seen in FIGS. 7 and 8, it is further preferable that mounting means 31 include retainer means 209 which is cooperatively formed with end 201 to permit mounting of mast 22 to, and removal of the mast from, cavity 203 only when the mast is substantially normally oriented and is free of lateral thrust forces. Thus, mast end 201 can be formed with an enlarged head 211 and a neck portion 212 dimensioned so that head 211 will pass through a selected one of openings 213 in retainer means 209. As best may be seen in FIG. 7, retainer means 209 may include a plurality, in this case four, cavities each having openings 213 through which head 211 is dimensioned to pass when the mast is in a generally vertical orientation and when there is no lateral thrust which will urge the neck against the edges defining openings 213. Openings 213 are positioned in the fore-and-aft directions so as to cooperate with the location of slots 207 for receipt of the truncated pyramid cassette or collar 202.

In order to enhance the self-supporting feature of mast mounting means 21 and yet permit tilting of the mast, it is preferable that a resiliently displaceable member 216 be positioned between mast 22 and collar 202. Resiliently displaceable member 216 can take several forms, but it is most preferably a foamed natural or synthetic rubber-like material. Optionally, it can be a fluted block of non-foam material or even a spring assembly.

Resilient body 216 will automatically tend to displace mast 22 to a "released" position, i.e., a position which results when the sailor lets go of the mast. If resilient member 216 is symmetrical and uniform in its spring biasing, the released position will be normal to sailboard body 30, but the released position may also include a forward lean or cant as shown in FIG. 2 of the drawing.

As will be appreciated, it is also possible for pyramid collar 202 to have the same configuration for both novice and expert sailors, and for resilient member 216 to have a resiliency which permits displacement to about a full 30 degrees for expert sailors or less resiliency which will allow displacement only of about 10 or 15 degrees for novice sailors. Similarly, as shown in FIG. 7, collar 202 can be asymmetrical so as to permit displacement in an aft direction of about 30 degrees and displacement in a fore direction of only about 20 degrees.

Securement of resilient member 216 in collar 202 and coupling of the same to mast 22 can be accomplished in a number of manners. As shown on the drawing, a sleeve 217 is mounted to mast 22 by a pair of clamping rings 218 and 219 which limit axial displacement of sleeve 217 along the mast. It is preferable for mast 22 to be rotatable within sleeve 217. Carried by sleeve 217 are a pair of washers 221 and 222 which bear against the upper and lower surfaces of resilient block 216. These washers help transfer the load of angular displacement to the resilient block. Block 216 can advantageously be adhesively secured or vulcanized to collar 202 and may be optionally secured to sleeve 217.

As will be appreciated, other limited displacement mounting means 31 would be suitable for use in the sailboard assembly of the present invention. It is contemplated, for example, that head 212 could be replaced by a socket which could be mounted over a protruding head on retainer means 209. Similarly, other manners of constructing a head or ball on the end of mast 22 may be employed, and it is not necessary in the broadest concept of the present invention that a cassette and retainer structure having a plurality of mounting locations be employed.

Steering Subassembly.

Figure 3:
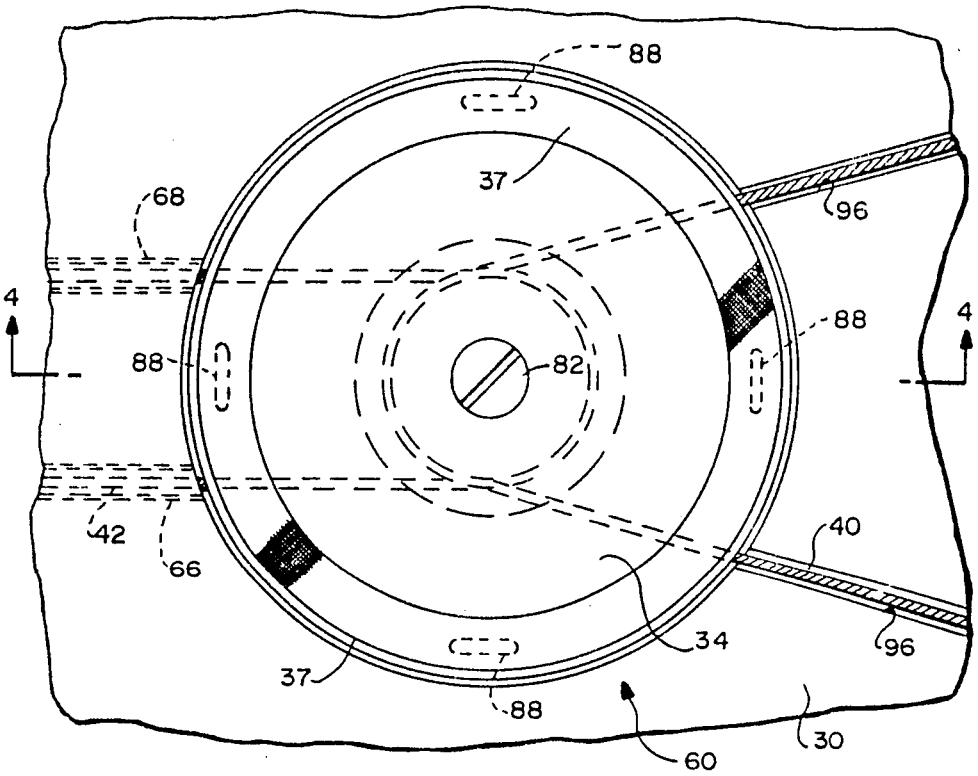
FIG. 3 is an enlarged, fragmentary, top plan view of the aft turntable of the sailboard assembly of FIG. 1.
Figure 4:
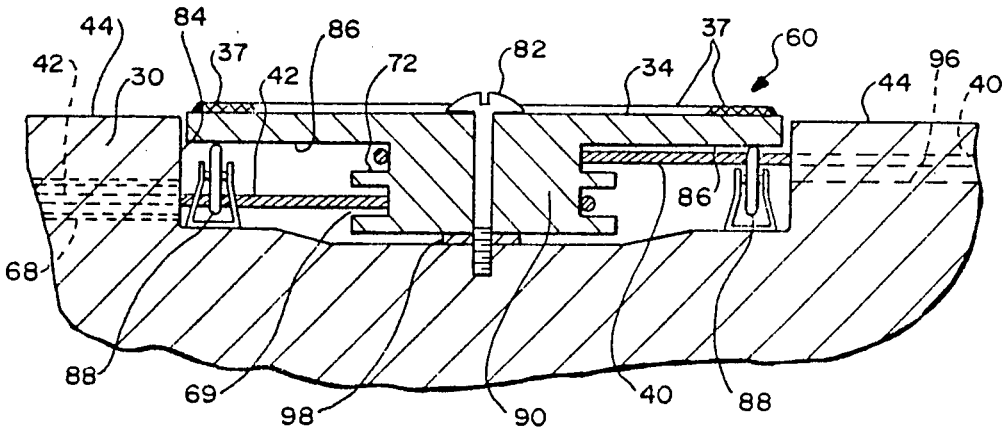
FIG. 4 is a side elevation view in cross-section taken substantially along the plane of line 4—4 in FIG. 3.
Figure 5:
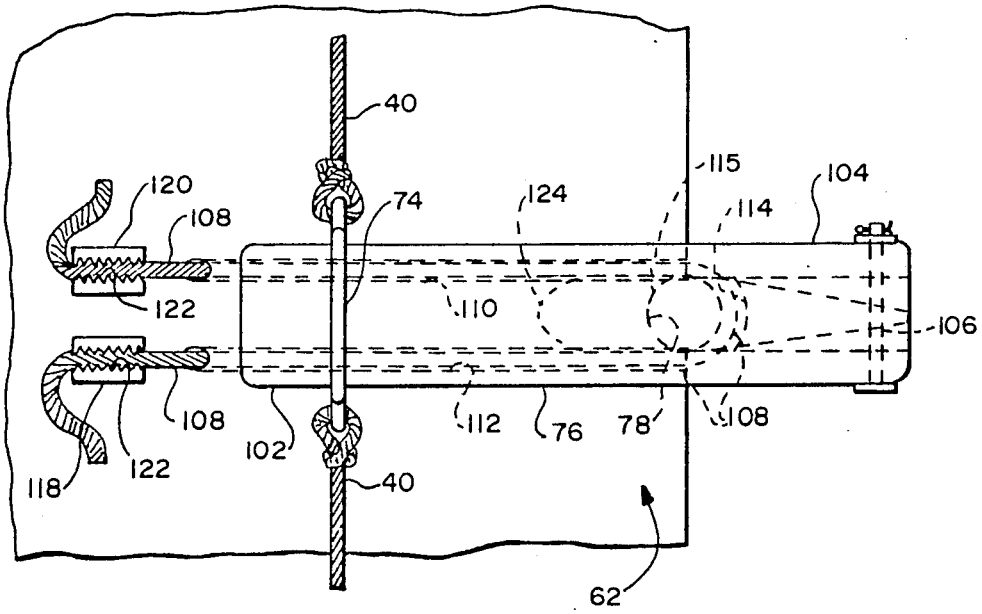
FIG. 5 is an enlarged, fragmentary, top plan view of the rudder mechanism of the sailboard assembly of FIG. 1.
Figure 6:
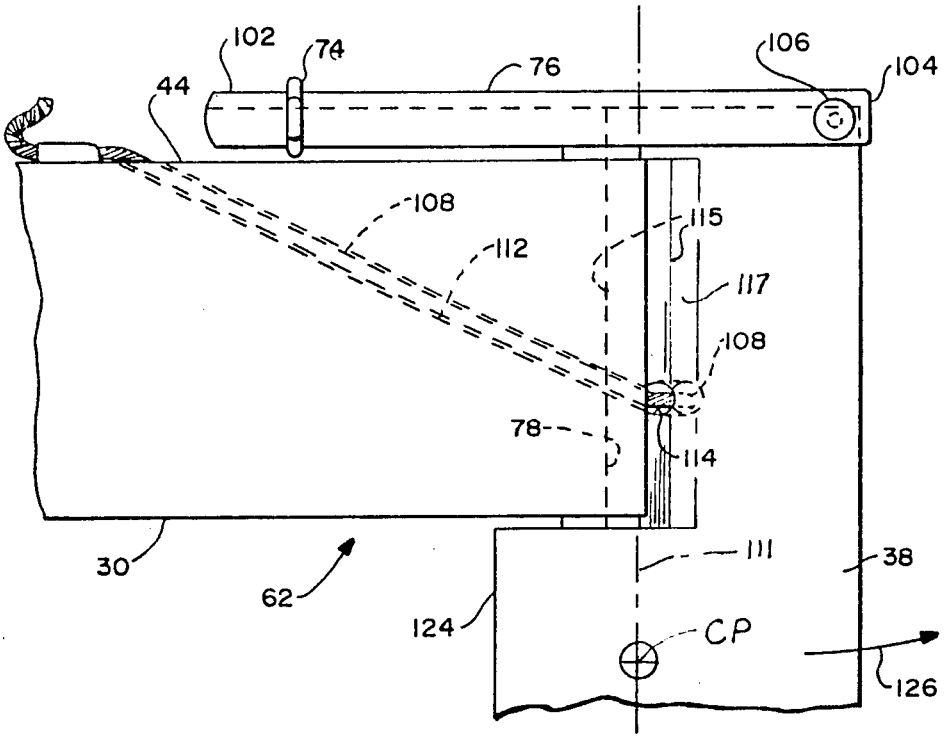
FIG. 6 is a side elevation view corresponding to FIG. 5.

The details of construction of steering subassembly 32 may best be seen in FIGS. 3 and 4, showing the first or aft turntable subassembly 60, and FIGS. 5 and 6, showing rudder mechanism subassembly 62.

In FIGS. 1 and 2, steering means 32 shows previously described first turntable 34 and second turntable 36. A friction pad 37 is secured to the top of each turntable so the user's foot can push against and turn the turntables. Turntable 34 is coupled to tiller 76 with first cable 40.

Additional detailed structure includes a first tube 66 recessed into body 30 between turntables 34 and 36. Likewise recessed is a second tube 68, aligned substantially parallel to tube 66. Previously described second cable 42 is wrapped around a lower grooved portion 69 of turntable 34 and a corresponding grooved hub portion (not shown) on turntable 36 so rotation of one turntable causes rotation of the other. Tubes 66 and 68 are covered so the user will not trip on either the tubes or the cables, and turntables 34 and 36 are preferably mounted substantially flush with top surface 44 of the body of the sailboard so as to be convenient for use and yet not be a hazard.

Between first turntable 34 and tiller 76, first cable 40 is mounted in a groove 96 open to top surface 44, and cable 40 wraps around another groove 72 on the hub portion of turntable 34. The ends of cable 40 are attached to a tiller ring 74 (FIGS. 5 and 6) slidably mounted on tiller 76. Tiller 76 is preferably formed with an inverted U-shaped cross-section and has a fore end 102 which fits through ring 74 and an aft end 104 connected toward the top of rudder 38 by pin 106.

As best may be seen in FIG. 1, cable 40 intermediate turntable 34 and tiller 76 passes over a pair of pulleys 70 and 72 so as to enable pivoting of rudder 38. Turntable 34 is rotatably mounted by a bolt 82 within a cylindrical chamber 84 provided in body 30. As visible from FIG. 4, secured to body 30 within chamber 84 are a plurality of support roller elements or wheels 88, for carrying an extended lip 86 provided on turntable 34. Wheels 88 resist downward forces on the turntable lip while allowing rotation of the turntable. A cylindrical hub 90 is positioned toward the center of turntable 34, and is penetrated by bolt 82. Hub 90 has an upper groove 72 and a lower groove 69 for receipt of the cables coupling first turntable 34 to the rudder and the second turntable.

Instead of turntables, a sliding mechanism (not shown) can be used. With this arrangement, footslides can be mounted on body 30. The footslides are then coupled by a subsystem of pulleys and cables to each other and to tiller 76. The user, by stepping on and moving a footslide, can move the cable subsystem to operate the rudder in the manner described above regarding the turntables.

In the preferred form of the sailboard of the present invention, two turntables 34 and 36 are provided. This enables the sailor to more easily reach and control the steering assembly whether he is standing close to the mast or close to the rudder. The sailboard assembly of the present invention can employ only a single turntable to control rudder steering. Since most of the sailing will take place with the user in general proximity of the mast, turntable 36, or a turntable positioned somewhat aft of the position of turntable 36, would be employed. Cable 42 would then be pulley mounted and directly connected to tiller 76.

The use of turntables, whether one or more is employed, affords a very significant advantage. A turntable provides a mechanism which is compact and yet enables differential motion. By selecting the turntable rim and pulley diameters it is possible to obtain any desired rate of steering motion of rudder 38. As will be seen, rim 37 has a larger diameter than pulley grooves 69 and 92. This reduces the rate of rudder motion and avoids oversteering and loss of control. As will be appreciated, the length of tiller 76 is also a factor in the rate of turning of the rudder, and must be considered with the rim and pulley diameters. Thus, turntable surface 34 preferably is larger in diameter than pulley 90. Similarly, the two turntables may have differing diameters and/or ratios of diameter between the turntables and the pulley to produce the desired steering rates. Most preferably the aft turntable 34 has a smaller pulley than fore turntable 36 to enable better control at high speed.

Still another alternative foot actuated steering assembly to the turntable or foot slide approaches is to use a lever-based system. A long lever extending from tiller 76 is possible, but cumbersome. A lever which can be laterally pivoted just above the board and which is coupled through cables similar to cable 40 to tiller could also be employed. This approach has disadvantages when considering the sailor's need for movement over the board.

It is necessary that steering means 32 be capable of maintaining rudder 38 at a given angle when the rider removes his foot from turntables 34, 36. This can be accomplished by providing means for applying a force, such as a limited friction force, which will resist rotation of the rudder and turntables. The pulley system above described inherently has friction in it which resists motion. Additionally, turntables 34 and 36 can be mounted on bearing washers, such as washer 98 (FIG. 4) so that vertical adjustment of bolt 82 will cause turntable 34 to be urged into varying frictional contact with washer 98 and support wheels 88. If the rudder tends to straighten out when the turntables are no longer engaged by the rider's foot, bolt 82 can be cinched down until the sufficient friction is present in the system to maintain the rudder at the desired angle.

As described below, it is a further important feature of the present invention that rudder 38 be pivotally mounted on an axis very near the rudder's center of pressure so that water pressure on the rudder creates very little torque acting to turn the rudder. Thus, complex frictional braking as shown in the German Patent No. 2,731,266 to Schwaiger is not required in the sailboard assembly of the present invention.

Rudder Mechanism Subassembly.

As above described, tiller ring 74 slips onto a tiller fore end 102, and is coupled to first cable 40 for steering rudder 38. At a tiller aft end 104, a pin 106 penetrates tiller 76 for pivotally coupling rudder 38 to tiller 76. A rudder cord 108 is fed through a pair of backward slanting first and second channels 110 and 112. Cord 108 is also slipped through a rudder hole 114, which penetrates rudder 38 close to, but spaced from, arcuate, vertically extending, rudder surface 115.

In order to pivotally secure rudder 38 to board body 30 it is preferable to provide a vertically extending arcuate notch or groove 78 dimensioned to matingly receive arcuate rudder surface 115. A means for tension or resilient mounting of the rudder in groove 78, such as jam cleats 118 and 120, is secured to the top of body 30 a short distance in front of tiller fore end 102. The two ends of cord 108 are secured into cleats 118 and 120 by pulling on cord 108 and shoving it into a set of gripping teeth 122 provided within jam cleats 118 and 120. Cord 108 is stretchable; a bungey cord works very well for securing rudder 38 to body 30.

An advantage of this means for securing rudder 38 to body 30 is that rudder 38 can yield to obstacles (not shown) such as submerged objects in water. If a leading edge 124 of rudder 38 encounters an obstacle such as a rock, edge 124 will press against the rock, rudder 38 will pull on and stretch rudder cord 108, and rudder 38 will pivot about pin 106 in a direction indicated (in this example, counter-clockwise) by an arrow 126. After the obstacle has been cleared, tension exerted by rudder cord 108 through rudder hole 114 pulls rudder 38 forward so rudder 38 pivots clockwise about pin 106 until reseated in body notch 78.

As may be seen from FIG. 6, rudder 38 is preferably mounted to board 30 for rotation about axis 111. Leading edge 124 can be seen to extend in the fore direction from axis 111, which causes the center of pressure, CP, of the rudder to be located almost on axis 111. Since the moment arm about axis 111 is relatively small, torque produced by water pressure on the rudder can be relatively small. As also is best seen in FIG. 5, cylindrical surface 115 extends beyond 180 degrees, for example 260 degrees, so that the rudder can be pivoted by about 40 degrees in either direction. The rudder is relieved at 117 on both sides in FIG. 6 to accommodate pivoting cylindrical surface 115.

The sailboard assembly also preferably includes centerboard 80 which is formed in a conventional manner and has been in use on sailboat and sailboards for many years.

Boom Subassembly.

Prior sailboards have employed booms which are generally arcuate or bowed so that they extend toward the rider allowing him to hike out on the side of the board opposite the sail to balance the wind's force. Boom means 24 of the sailboard of the present invention preferably also is arcuate or bowed outwardly to a substantial degree, as shown in FIG. 1.

One of the important advantages of providing a boom mounting means 31 which permits limited angular displacement is that the boom can be displaced sufficiently to avoid two problems which commonly occur with fixed mast sailboards. First, when the board is being sailed in a close-hauled condition, boom 24 and sail 28 are very close to the centerline of the board. When a bowed boom such as is shown in FIG. 1 is employed, the side of the boom nearest the sailor tends to push the sailor off the board when the boom is close-hauled, unless the mast can be tilted away from the sailor and the centerline of the board to permit standing on the board. Thus, the limited-tilt mount 31 of the sailboard of the present invention permits close-hauled sailing by allowing mast 22 to be tilted away from the sailor to a sufficient degree that even a bowed boom 24 can be employed.

The converse problem occurs in heavy wind when the sailor must hike out or lean to windward to provide a righting moment to the board. The outward bow of boom 24 allows the boom to reach out towards the sailor, and additionally, the mast can be tilted toward the sailor so that the combination of mast tilt and bowing of boom 24 avoids the need for boom extension handles, trapeze assemblies and the like.

The sail and mast subassemblies on the sailboard of the present invention can be formed in a manner which is conventional for universal joint-mounted mast sailboards. Accordingly, the details of mounting of the same will not be described herein.

Operation.

Using the sailboard assembly above described, a novice can more rapidly learn sailboarding techniques. A tiltable, but relatively limited displacement, mast mounting cassette 31 can be mounted to board 30 to provide the novice with greater balancing assistance. Moreover, the novice can employ standard sailing techniques, with which he may already be familiar, to steer the board primarily by steerable rudder 38. Displacement of the mast, however, allows assistance in steering and close-hauled and heavy wind situations.

For the more advanced or skilled sailor, a relatively flexible cassette can be mounted to the board so that the mast can be tilted through an angle sufficient to permit significant displacement of the center of pressure of the sail to permit steering alone or in combination with steerable rudder 38.

Whether novice or skilled, the rider can enjoy rides of several hours without tiring from the effort of supporting the mast. This, in turn, greatly facilitates the building of sailing skills and enhances enjoyment. Moreover, the sailboard of the present invention has greater maneuverability and is steadier in the water during use.

As will be appreciated, the limited angular displacement mast and foot-operating steering of the sailboard of the present invention is easily adaptable to land vehicles, such as ice sailing and land sailing equipment on which the operator rides in a standing position.

What is claimed is:

1. In a wind-propelled sailboard assembly including a board-like body on which a sailor may stand, a mast movably mounted to said body for angular displacement about an enlarged end thereof, manually engageable boom means carried by said mast and extending away therefrom, sail means mounted to said mast and coupled to said boom means, and mounting means removably mounting said mast to said body and including retainer means engaging said enlarged end of said mast and mounting said enlarged end for limited angular displacement of said mast about a normal orientation to said body, said mounting means further including a rigid collar mounted to said body in spaced apart generally concentric relation to said mast, said collar having a height dimension along said mast proximate said enlarged end, and a resilient member positioned between said mast and said collar and supporting said mast in an upright orientation with respect to said body when said boom means is released by said sailor and said mast moves to a released position, and said mounting means permitting sufficient manual angular displacement of said mast relative to said body by manipulation of said boom means by said sailor to enable balancing of the helm of said sailboard by tilting of said mast, wherein the improvement in said sailboard assembly comprises:

said resiliently displaceable member substantially filling the volume between said mast and said collar over said height of said collar and biasing said mast toward said released position upon any angular displacement of said mast from said released position in any direction toward said collar; and said retainer means being provided by a member mounted to said body and having an opening therein dimensioned for and slidably receiving said enlarged end of said mast therethrough.

2. The sailboard as defined in claim 1 wherein, said resiliently displaceable member is provided by a foamed rubber-like material.

3. The sailboard assembly as defined in claim 1 wherein, said mounting means includes a retainer means having an opening cooperatively formed and oriented with respect to said enlarged end of said mast to permit mounting of said enlarged end of said mast to and removal of said enlarged end of said mast from said opening in said retainer means only when said mast is substantially in said released position and is free of forces lateral to said mast.

4. The sailboard assembly as defined in claim 1, and steering means mounted to said body and operable by the foot of the sailor while standing on said body, said steering means including a movable rudder rotatably mounted to said body proximate an aft end thereof, a first turntable mounted toward said aft end for rotation in a horizontal plane, a second turntable mounted toward a fore end of said body for rotation in a horizontal plane at about the plane of the top surface of said body, and means coupling said rudder to both said first turntable and said second turntable for rotation of said rudder by both of the turntables.

5. In a wind-propelled sailboard assembly including a board-like body on which a sailor may stand, a mast movably mounted to said body for angular displacement about an end thereof, manually engageable boom means carried by said mast and extending away therefrom, sail means mounted to said mast and coupled to said boom means, and mounting means mounting said mast to said body for limited angular displacement about a normal orientation to said body, said mounting means having means supporting said mast in an upright orientation with respect to said body when said boom means is released by said sailor, and said mounting means permitting sufficient manual angular displacement of said mast relative to said body by manipulation of said boom means by said sailor to enable balancing of the helm of said sailboard by tilting of said mast wherein the improvement in said sailboard assembly comprises:

said mounting means is provided as a removable cassette-like assembly including said means supporting said mast, and said body and said cassette-like assembly being cooperatively formed for selective mounting of said cassette-like assembly including said means for supporting said mast at any one of a plurality of side-by-side locations spaced apart from each other by a distance along said body less than the length along said body of said cassette-like assembly.

6. The sailboard assembly as defined in claim 5 wherein, said body is formed with a cavity dimensioned to receive said cassette-like assembly therein, said cavity including a plurality of pairs of slots in opposite side walls thereof; and said cassette-like assembly including a pair of flanges extending laterally from opposed sides of said cassette-like assembly and mounted in sliding mating engagement with a selected one of said pairs of slots.

7. The sailboard assembly as defined in claim 6 wherein, said slots and said flanges are both inclined with respect to the vertical in a direction toward the aft of said body.

* * * * *

UNITED STATES PATENT AND TRADEMARK OFFICE

CERTIFICATE OF CORRECTION

PATENT NO. : 4,679,516

DATED : July 14, 1987

INVENTOR(S) : Terry V. Friesen

It is certified that error appears in the above-identified patent and that said Letters Patent are hereby corrected as shown below:

Front Page:

Title: Delete "DIPLACEMENT" and insert ---DISPLACEMENT---.

COL. 1, Title: delete "DIPLACEMENT" and insert

---DISPLACEMENT---.

COL. 1, line 43, delete "point" and insert ---joint---.

CLAIM 1:

Signed and Sealed this

Second Day of February, 1988

*Attest:*

DONALD J. QUIGG

*Attesting Officer*

*Commissioner of Patents and Trademarks*